US007467795B2

(12) United States Patent
Middleton, Jr.

(10) Patent No.: US 7,467,795 B2
(45) Date of Patent: Dec. 23, 2008

(54) MODIFIABLE GAME

(76) Inventor: John L. Middleton, Jr., 24420 S. Myers Ct., Peculiar, MO (US) 64078

( * ) Notice: Subject to any disclaimer, the term of this patent is extended or adjusted under 35 U.S.C. 154(b) by 46 days.

(21) Appl. No.: 11/551,354

(22) Filed: Oct. 20, 2006

(65) Prior Publication Data

US 2008/0093801 A1 Apr. 24, 2008

(51) Int. Cl.
*A63F 3/00* (2006.01)

(52) U.S. Cl. ..... 273/239; 273/283

(58) Field of Classification Search ..... 273/239, 273/284, 283

See application file for complete search history.

(56) References Cited

U.S. PATENT DOCUMENTS 4,016,939 A 4/1977 Thron
4,078,803 A 3/1978 Te
4,082,284 A 4/1978 Jennings
4,101,131 A * 7/1978 Barnby ..... 273/239
4,348,191 A 9/1982 Lipsitz et al.
5,280,914 A * 1/1994 Selby et al. ..... 273/287
5,988,636 A * 11/1999 Kilmer ..... 273/108.1

FOREIGN PATENT DOCUMENTS

GB 2209956 A * 6/1989

* cited by examiner

*Primary Examiner*—Vishu K. Mendiratta
(74) *Attorney, Agent, or Firm*—Dale J. Ream

(57) ABSTRACT

A modifiable game according to the present invention includes a magnetic base, at least one game token, a plurality of user tokens, and a plurality of overlays. Each overlay may include starting and ending indicia, segmented path spaces, and indicia, such as artwork, representing different themes. Each overlay is preferably uniquely different from any other overlay so as to present unique game experiences. Game tokens may be positioned on the game board or overlay prior to the start of game play and each game token may correspond with another indicia on the board. If a player's user token lands on a path space adjacent the game token, he may advance immediately to a path space adjacent the corresponding indicia. The modifiable game may also include means for advancing user tokens along the path spaces, such as one or more die, a spinner, or even an electronic device.

12 Claims, 5 Drawing Sheets

MODIFIABLE GAME

BACKGROUND OF THE INVENTION

This invention relates generally to games and, more particularly, to a board game that is modifiable for more unique game play over time or when new themes are desired.

Board games provide fun and enjoyment to both children and adults. In addition, playing board games provides for quality interaction between family and friends. Another benefit of many board games is to enhance the level of education or experience of the players. For example, a game may require a player to read and understand certain facts, deduce unknown information, answer trivia questions, or otherwise solve problems. Other games merely include a game board on which players are able to move based solely on chance, such as by rolling dice or spinning a spinner.

Although these types of games assumably satisfy their intended objectives, they may eventually do not hold a player's attention and game usage decreases. For example, a user who plays a board game that merely allows movement from start to finish based solely on chance may grow bored with the lack of variation. This problem becomes greater still if there is a lack of knowledge acquisition or a challenge of the player's intellectual acumen.

Therefore, it would be desirable to have a modifiable game having a base and a plurality of playing surface overlays that may be selectively used by a player so as to selectively vary game play. Further, it would be desirable to have a modifiable game in which each overlay presents a different theme, including artistic indicia or information relevant to the theme. Specific artistic renderings related to the theme and user token movement modifiers further increase the excitement to the players. In addition, it would be desirable to have user tokens and game tokens that are magnetically attracted to the base.

SUMMARY OF THE INVENTION

A modifiable game according to the present invention includes a magnetic base, at least one game token, a plurality of user tokens, and a plurality of overlays. Each overlay may include starting and ending indicia and indicia representing different themes, such as zoo theme, barnyard fun, an aquatic park, a tour of Africa, and such like. Each overlay is preferably uniquely different from any other overlay so as to present unique game experiences. Game tokens may be positioned on the game board or overlay prior to the start of game play and each game token may correspond with another indicia on the board. If a player's user token lands on a path space adjacent the game token, he may advance immediately to a path space adjacent the corresponding indicia. The modifiable game may also include means for advancing user tokens along path spaces, such as one or more die, a spinner, or even an electronic device.

Preferably, the indicia on the base, overlays, and user and game tokens are relevant to various animal themes. For example, the overall theme represented on one overlay and related game pieces may be a tour of Africa. This type of overlay and tokens would include representations of animals such as lions, tigers, monkeys, and the like. Indicia on the overlay may include pictures of habitats of these animals. Means for enabling a player to move his token from one path space to another path space may include a giraffe's long neck. On the other hand, indicia such as quick sand or monkeys may cause player's to lose turns or move backward. A different overlay may have a completely different theme. Thus, the overlays and ability to select new locations for game tokens creates the exciting possibilities of many game variations.

Therefore, a general object of this invention is to provide a modifiable game in which players may choose from a plurality of overlays for participating in a variety of game experiences.

Another object of this invention is to provide a modifiable game, as aforesaid, in which each overlay includes a theme different from any other overlay.

Still another object of this invention is to provide a modifiable game, as aforesaid, that includes an educational aspect in that users may observe and learn about animals from around the world and be called upon to associate animals with their habitats.

Yet another object of this invention is to provide a modifiable game, as aforesaid, which includes game and user tokens according to the theme of the game board or overlay.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
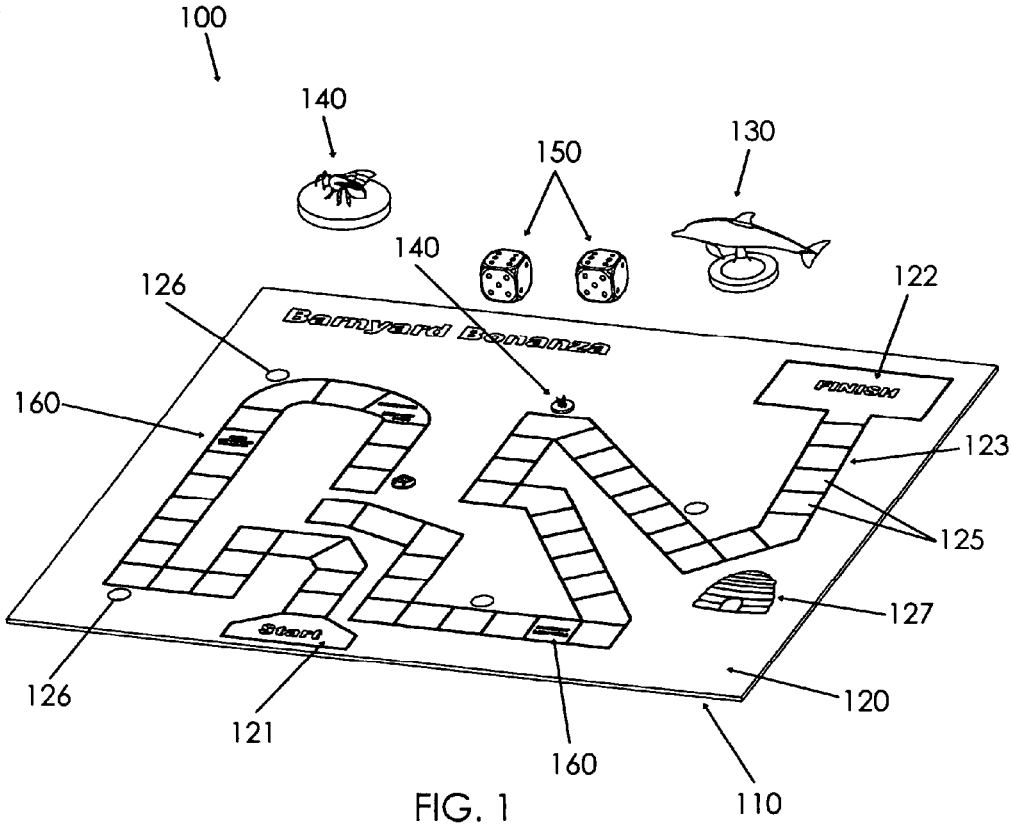
FIG. 1 is a perspective view of a modifiable game according to a preferred embodiment of the present invention.

A modifiable game 100 according to the present invention will now be described in detail with reference to FIGS. 1 through 5*b* of the accompanying drawings. More particularly, a modifiable game 100 according to the current invention includes a base 110, a plurality of overlays 120, a plurality of user tokens 130, and at least one game token 140.

Figure 2:
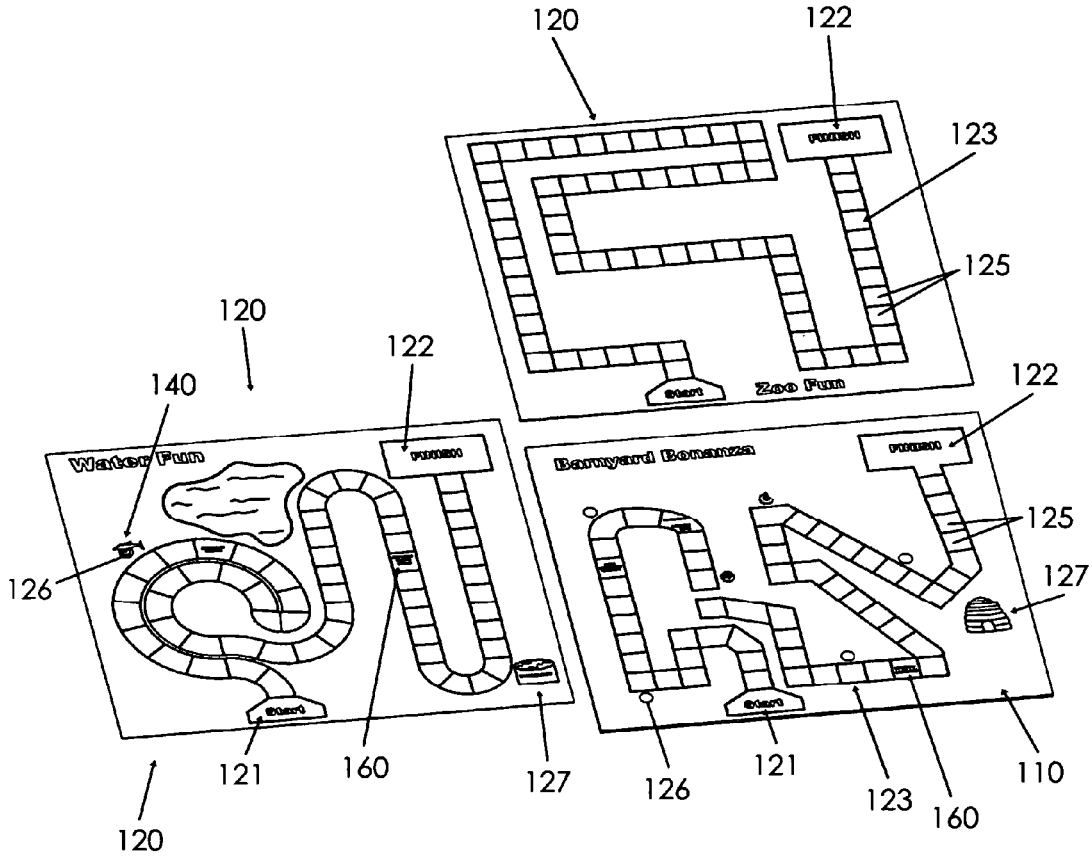
FIG. 2 is another perspective view of the modifiable game with additional overlays.

As shown in FIGS. 1 and 2, each overlay 120 may have a configuration complementary to a configuration of the base 110 so that the respective overlays 120 may be received by the base 110. The base 110 may be magnetic, and each overlay 120 may be magnetically attachable to the base 110 although other fasteners would also be suitable. Each overlay 120 includes beginning indicia 121, ending indicia 122, and segmented pathway indicia 123 defining a plurality of path spaces 125 connecting the beginning and ending indicia 121, 122. At least one overlay 120 may additionally include game token receiving indicia 126 adjacent various path spaces 125 for receiving the game token(s) 140 and/or include indicia 127 corresponding to the game token(s) 140 adjacent path space(s) 125. As shown in FIG. 1, the game token receiving indicia 126 may be a hole defined by the respective overlay 120 exposing the base 110. Each overlay 120 may be uniquely different from each other overlay 120 to provide a variety of game experiences.

Figure 4A:
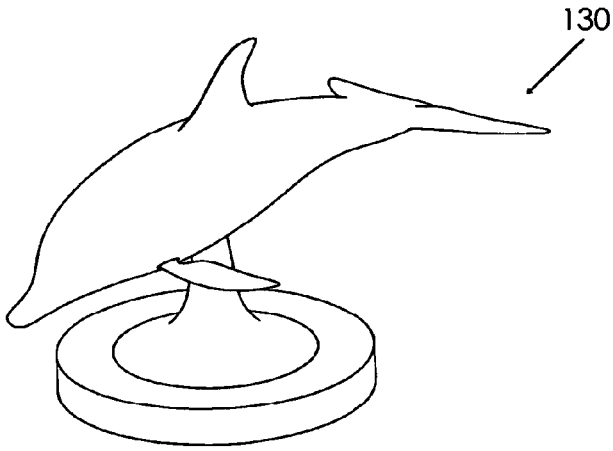
FIG. 4*a* is a perspective view of a user token as in FIG. 1.
Figure 4B:
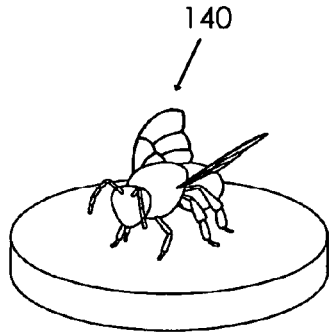
FIG. 4*b* is a perspective view of a game token as in FIG. 1.
Figure 4C:
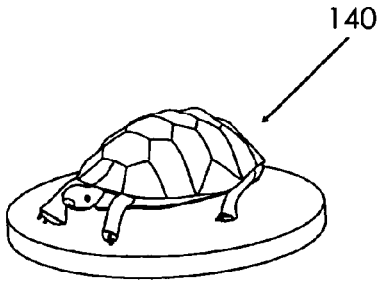
FIG. 4*c* is a perspective view of another game token according to the present invention.
Figure 4D:
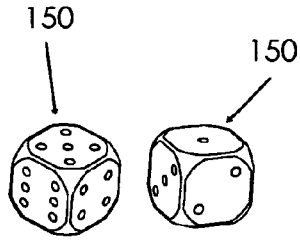
FIG. 4*d* is a perspective view of the dice as in FIG. 1.
Figure 4E:
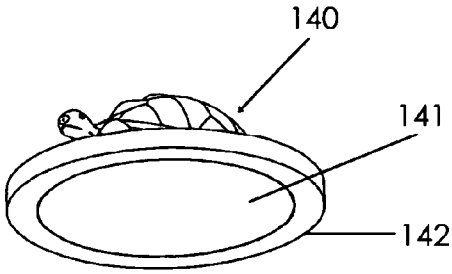
FIG. 4*e* is another perspective view of the game token as in FIG. 4*c;*
Figure 5A:
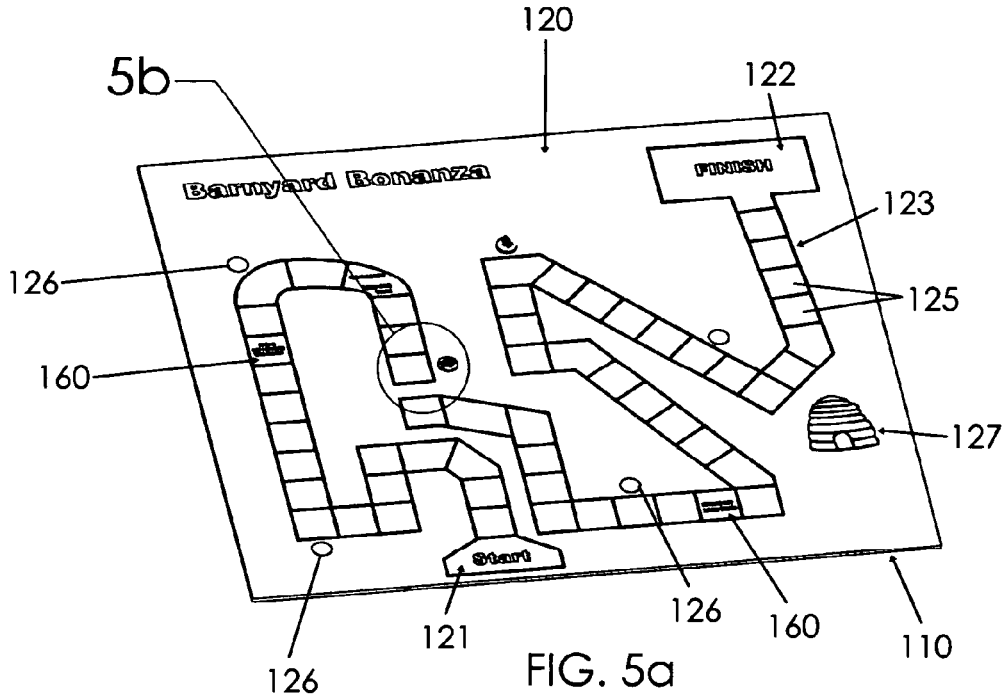
FIG. 5*a* is another perspective view of the base as in FIG. 1.
Figure 5B:
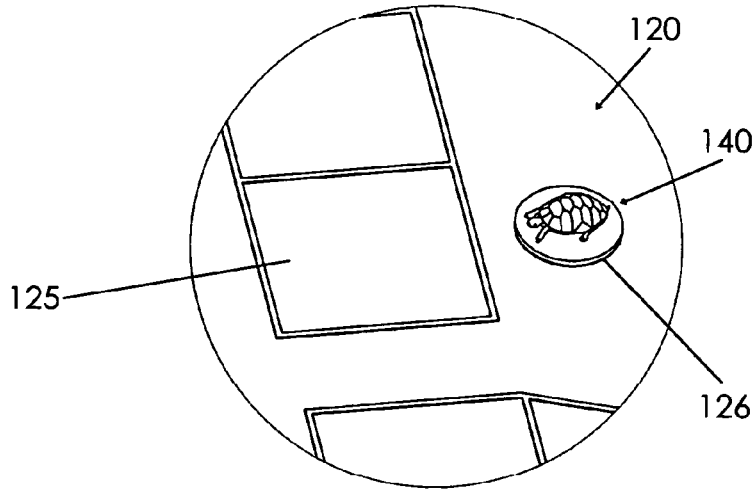
FIG. 5*b* is a perspective view on an enlarged scale of a path space and game token as in FIG. 1.

The game tokens 140 may represent living creatures such as a bumble bee (FIGS. 1 and 4*b*), a turtle (FIGS. 4*c* and 4*e*), and/or others, and the indicia 127 corresponding to the game tokens 140 may represent habitats for the living creatures. For example, as shown in FIG. 1, the indicia 127 represents a bee hive that corresponds to the bumble bee game token 140. The game tokens 140 and/or the user tokens 130 may be magnetically attachable to the magnetic base 110, even when the magnetic base 110 is covered by one or more respective overlay 120. FIG. 4*e* shows that the game tokens 140 may have a metallic or magnetic area 141 adjacent a bottom surface 142. Further, game tokens 140 may be utilized as user tokens 130, such as the dolphin shown in FIGS. 1 and 4*a*, for example.

Similar to the overlays 120, the base 110 may also include beginning indicia 121, ending indicia 122, segmented pathway indicia 123 defining a plurality of path spaces 125 connecting the beginning and ending indicia 121, 122, and game token receiving indicia 126 adjacent various path spaces 125 for receiving any of the game tokens 140 (FIG. 2). As such, the game 100 may provide an additional game experience without requiring an additional overlay 120.

Means for directing advancement of the user tokens 130 along the path spaces 125 may be included. More particularly, the modifiable game 100 may include one or more die 150 (FIGS. 1 and 2*d*), a spinner that randomly points to one of a plurality of numbers upon being spun, a plurality of playing cards that include respective numbers, an electronic indicator, and/or another device capable of signaling a random number.

Figure 3A:
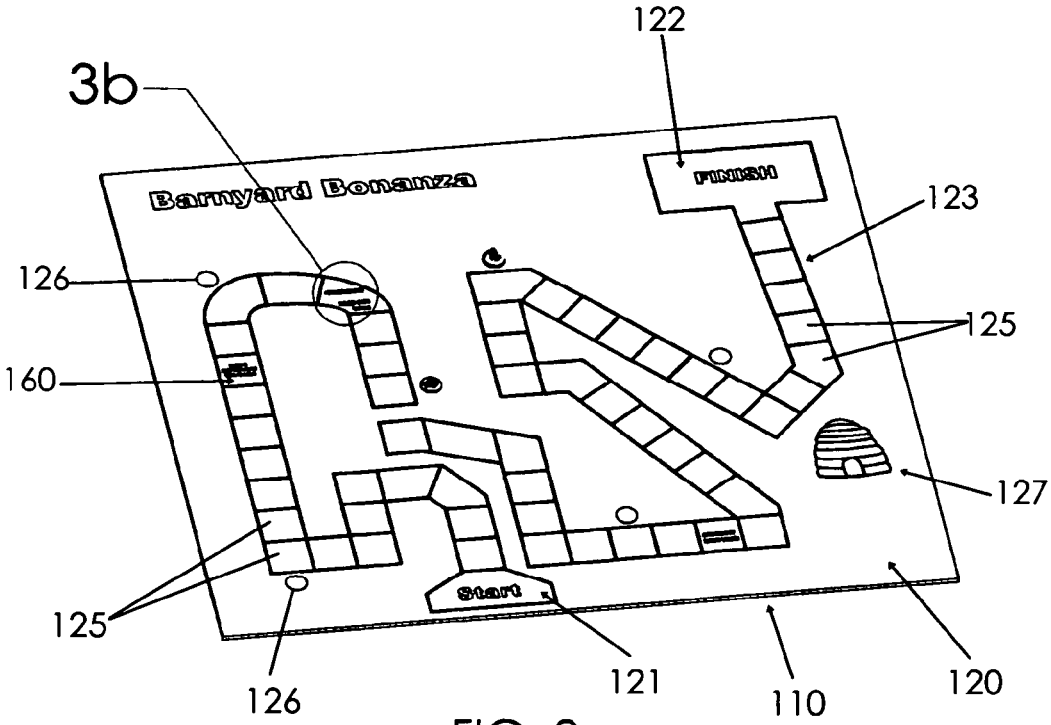
FIG. 3*a* is another perspective view of the modifiable game as in FIG. 1 with the dice, user tokens, and game tokens removed.
Figure 3B:
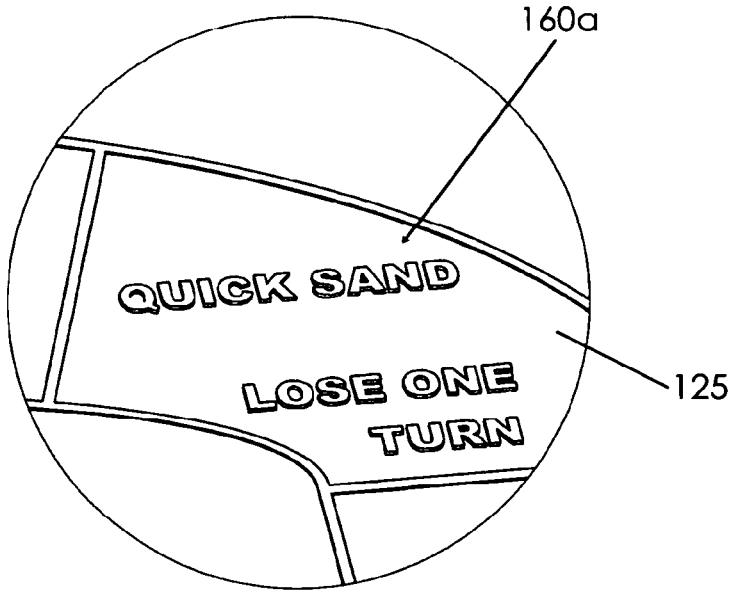
FIG. 3*b* is a perspective view on an enlarged scale of a path space taken from FIG. 3*a;*

Means for randomly indicating at least one game token 140 may be included. More particularly, the modifiable game 100 may include indicia 160 associated with a respective path space 125 and the respective game token 140, indicia associated with a respective playing card and the respective game token 140, and/or other randomly indicated indicia associated with the respective game token 140. Similar to the indicia 160, indicia 160*a* that does not correspond to a game token 140 but that directs a player to perform an act (e.g., "lose one turn", as shown in FIG. 3*b*) may be included.

In use, players may choose user tokens 130, place a unique overlay 120 atop the base 110, and place one or more game token 140 upon the game token receiving indicia 126. The game experience can vary greatly depending on the modifications made by the players (e.g., which overlay 120 is used, how many game tokens 140 are placed upon the game token receiving indicia 126, and which game token receiving indicia 126 those game tokens are placed upon). The user tokens 130 may be placed at the beginning indicia 121, and a first player may utilize the die 150 or other appropriate device to determine a number of spaces 125 toward the ending indicia 122 that the user token 130 is to be moved. The first player's user token 130 may then be moved the determined number of spaces 125 toward the ending indicia 122.

If the user token 130 lands on a space 125 adjacent a game token 140, the user token may be moved to the space 125 adjacent the indicia 127 corresponding to the game token 140. For example, if the user token 130 lands on the space 125 adjacent the bumble bee game token 140 in FIG. 1, the user token 130 may be moved to the space 125 adjacent the bee hive indicia 127. As the player has to associate the game token 140 with the corresponding indicia 127, there is an educational aspect to the modifiable game 100.

If the user token 130 lands on a space 125 having indicia 160 associated with a respective game token 140 (e.g., if the space 125 includes the name of the game token 140, a picture of the game token 140, or an item commonly associated with the game token 140,) the user token 130 may be moved to the space 125 adjacent the game token 140. If the game token 140 was initially placed upon a game token receiving indicia 126 near the beginning indicia 121, the move may be detrimental to the player; if the game token 140 was initially placed upon a game token receiving indicia 126 near the ending indicia 122, the move may be beneficial to the player. If playing cards having indicia 160 associated with game tokens 140 are used, players may draw from a deck of the cards after moving the user token 130 as described above; if a blank card is drawn, the user's turn may be over; if a card having the indicia 160 is drawn, the user token 130 may be moved to the space 125 adjacent the game token 140 as described above. If, in yet another potential situation, a user token 130 lands on a space 125 have indicia 160 that gives an instruction, e.g. "lose turn," then the player loses one turn (FIG. 3*b*).

Players may alternate turns of proceeding as described above, and the first player to reach the ending indicia 122 may be declared the winner. Because of the user modifications possible as described above, players may enjoy countless games using the modifiable game 100 without tiring of the modifiable game 100.

It is understood that while certain forms of this invention have been illustrated and described, it is not limited thereto except insofar as such limitations are included in the following claims and allowable functional equivalents thereof.

The invention claimed is:

1. A modifiable game, comprising:

a plurality of user tokens;

a plurality of game tokens;

a magnetic base, said base including base beginning indicia, base ending indicia base segmented pathway indicia defining a plurality of base path spaces connecting said base beginning and base ending indicia, and base game token receiving indicia situated adjacent but not on various said base path spaces defined on said base for receiving any said game token as determined by a player prior to the start of game play;

a plurality of overlays, each overlay being magnetically attachable to said base and having beginning indicia, ending indicia, segmented pathway indicia defining a plurality of path spaces connecting said beginning and ending indicia, and game token receiving indicia situated adjacent but not on various said path spaces for receiving any said game token as determined by a player prior to the start of game play; wherein the game token receiving indicia is a hole defined by a respective overlay;

means for directing advancement of said user tokens along said path spaces; and indicia positioned on a respective path space that is associated with a corresponding game token, said indicia indicating that a user token upon becoming situated on said respective path space should be moved to another respective path space that is adjacent said game token associated with said indicia.

2. The modifiable game of claim 1, wherein at least one said overlay has indicia corresponding to at least one said game token adjacent a respective path space.

3. The modifiable game of claim 2, wherein at least one said game token represents a living creature and said indicia corresponding to at least one said game token represents a habitat for said living creature.

4. The modifiable game of claim 1, wherein:

each said game token is magnetically attachable to said magnetic base; and each said user token is magnetically attachable to said magnetic base.

5. The modifiable game of claim 1, wherein:

said magnetic base is covered by at least one said overlay; and each said game token is magnetically attachable to said magnetic base covered by said at least one overlay.

6. The modifiable game of claim 1, wherein said means for directing advancement of said user tokens along said path spaces includes at least one item selected from the group consisting of a die, a spinner, a plurality of playing cards, and an electronic indicator.

7. The modifiable game of claim 1, wherein each said overlay is uniquely different from each other said overlay.

8. The modifiable game of claim 1, further comprising a plurality of playing cards, a respective playing card having an indicia that is associated with a corresponding game token, said indicia indicating that a user token, on whatever respective path space it is currently situated, should be moved to another respective path space that is adjacent said game token associated with said indicia.

9. A modifiable game, comprising:

a plurality of user tokens;

a game token;

a base, said base including, said base including base beginning indicia, base ending indicia, base segmented pathway indicia defining a plurality of base path spaces connecting said base beginning and base ending indicia, and base game token receiving indicia situated adjacent but not on various said base path spaces defined on said base for receiving any said game token as determined by a player prior to the start of game play;

a plurality of overlays; each overlay having a configuration complementary to a configuration of said base for being received by said base; each overlay having beginning indicia, ending indicia, segmented pathway indicia defining a plurality of path spaces connecting said beginning and ending indicia, and game token receiving indicia adjacent to but not on various said path spaces for receiving said game token as determined by a player prior to the start of game play; wherein the game token receiving indicia is a hole defined by a respective overlay;

means for directing advancement of said user tokens along said path spaces;

indicia positioned on a respective path space that is associated with a corresponding game token, said indicia indicating that a user token upon becoming situated on said respective path space should be moved to another respective path space that is adjacent said game token associated with said indicia; and a plurality of playing cards, a respective playing card having an indicia that is associate with a corresponding game token, said indicia indicating that a user token, on whatever respective path space it is currently situated, should be moved to another respective path space that is adjacent said game token associate with said indicia.

10. The modifiable game of claim 9, wherein each said overlay is uniquely different from each other said overlay.

11. The modifiable game of claim 10, wherein:

said game token represents a living creature; and said indicia corresponding to said game token represents a habitat for said living creature.

12. The modifiable game of claim 9, wherein:

said means for directing advancement of said user tokens along said path spaces includes at least one item selected from the group consisting of a die, a spinner, a plurality of playing cards, and an electronic indicator.

* * * * *